United States Patent [19]

Consay

[11] Patent Number: 4,558,541

[45] Date of Patent: Dec. 17, 1985

[54] ICE SKATE SHARPENING METHOD

[75] Inventor: Joseph A. Consay, Calgary, Canada

[73] Assignee: Universal Skate Sharpeners Ltd., Calgary, Canada

[21] Appl. No.: 709,975

[22] Filed: Mar. 8, 1985

Related U.S. Application Data

[63] Continuation of Ser. No. 511,621, Jul. 7, 1983, abandoned.

[30] Foreign Application Priority Data

Jun. 10, 1983 [CA] Canada ..... 430108

[51] Int. Cl.[4] ..... B24B 9/04

[52] U.S. Cl. ..... 51/281 R; 51/91 BS; 51/96; 51/228

[58] Field of Search ..... 51/5 D, 91 R, 91 BS, 51/92 R, 92 BS, 94 R, 96, 100 R, 124 R, 165.71, 165.9, 165.92, 228, 281 R; 409/156, 162; 269/34

[56] References Cited

U.S. PATENT DOCUMENTS

| | | | |
|---|---|---|---|
| 2,850,926 | 9/1958 | Jobe | 269/34 X |
| 3,060,644 | 10/1962 | Wisti | 51/96 |
| 3,279,321 | 10/1966 | Muhl | 409/156 X |
| 3,415,017 | 12/1968 | Murray | 51/135 |
| 3,719,006 | 3/1973 | Vezeau | 51/100 R X |
| 3,735,533 | 5/1973 | Salberg | 51/228 X |
| 3,827,185 | 8/1974 | Smith | 51/228 X |
| 3,948,001 | 4/1976 | Miyazawa et al. | 51/165.92 X |
| 3,988,124 | 10/1976 | Babcock | 51/96 |
| 3,988,865 | 11/1976 | Weisman | 51/228 |
| 4,055,026 | 10/1977 | Zwicker | 51/228 |
| 4,094,101 | 6/1978 | Robinson | 51/5 D |
| 4,235,050 | 11/1980 | Hannaford et al. | 51/228 X |
| 4,392,332 | 7/1983 | Sakcriska | 51/92 BS |

*Primary Examiner*—Robert P. Olszewski

[57] ABSTRACT

A machine for sharpening the blade of an ice skate has a vertically mounted, thin grinding wheel with a convex transverse cross-section corresponding to the concave transverse cross-section desired for the blade edge. Clamping plates on a cradle hold the blade above the wheel with their central planes coplanar and with the wheel biassed against the blade. The cradle is pivotable about a horizontal axis above the skate so that the skate can be swung in an arc. Hence the movement of the blade over the wheel takes place in an arc that is curved in the same direction as the convex profile of the blade edge. This action reduces the problem of unevenness of depth of cut along the length of the blade, that has been experienced with prior machines employing straight line relative travel between the skate and the wheel. The tendency for the wheel to take a deeper cut at the more sharply curved toe and heel portions of the blade can be further compensated for by increasing the speed of traverse of the blade over the wheel in the vicinities of these end portions. This traversing speed can be reduced incrementally from a maximum at the extreme toe end of the blade down to a minimum over the central portion of the blade, while being increased again incrementally as the wheel approaches the heel end. Provision is also made for stopping the motor that drives the grinding wheel when the wheel is in the area of the picks of a figure skate.

6 Claims, 18 Drawing Figures

ICE SKATE SHARPENING METHOD

This application is a continuation of application Ser. No. 511,621, filed July 7, 1983, now abandoned.

RELATED APPLICATION

Attention is directed to copending application of J. A. Consay and D. R. Meier Ser. No. 511,622 filed concurrently herewith, now U.S. Pat. No. 4,534,134, and containing claims directed to some of the subject matter disclosed herein.

BACKGROUND OF THE INVENTION

The present invention relates to a machine for sharpening the blades of ice skates.

As is well known, the bottom edge of an ice skate blade is required to have a somewhat concave transverse cross-section so that a sharp ridge extends along each of the two side edges. This shape is maintained by grinding the blade periodically with a grinding wheel, the periphery of which has a corresponding convex shape in transverse cross-section. A typical machine for this purpose has been disclosed, for example, in U.S. Pat. No. 3,735,533 issued May 29, 1973 to M. Salberg (Canadian patent No. 920,819 dated Feb. 13, 1973).

The present invention has the general objective of providing improvements in this class of machine and, in particular, seeks an improvement in the uniformity of grinding along the length of the blade. The depth of metal to be removed from the blade will vary, e.g. from about 2 thousandths of an inch, in the case of a blade requiring only minor sharpening, up to about 10 thousandths of an inch in the case of a badly deteriorated blade. Whatever the depth of cut that is selected, it is important that essentially the same depth of cut be maintained along the full length of the blade. If a reasonable approximation to this ideal is not maintained, after repeated sharpening operations the basic profile of the blade will become significantly modified.

One of the principal difficulties with prior machines of this type has been a tendency for them to remove more metal from the ends of the blade, i.e. near the toe and the heel, than from the central portion of the blade, during each pass of the grinding wheel along the blade. A skate blade is initially constructed with a convex profile when seen in side view. In the longitudinally central portion of the blade this convexity is comparatively slight. At the ends, the curvatures are sharper, especially at the toe. This profile is designed to maximise the performance of the skate and it is therefore desirable to maintain such profile throughout the life of the blade. Removal of excessive metal from either or both of the toe and heel portions will distort this profile and shorten the life of the skate.

The tendency towards removal of more metal from the end portions than from the center, flows from the fact that, when a grinding wheel is urged against a skate blade in a direction perpendicular to the general longitudinal direction of the blade and the portion of the blade engaged by the wheel does not extend at right angles to such perpendicular direction due to the curvature of the blade, such portion contacts the wheel at a radius inclined to such perpendicular direction. Thus, if a uniform force is applied to bias the wheel in the perpendicular direction throughout a complete pass of the wheel along the blade, the blade resists this applied force by a somewhat larger force acting along the inclined radius, since the action and reaction forces between the blade and the wheel can only act along a radius normal to the tangential direction of the contact between the blade and the wheel.

A proposal to compensate for this effective increase of force between the blade and the wheel (and hence increased depth of cut) at the ends of the blade by varying the perpendicular biassing force in accordance with the grinding resistance (sensed by measuring the power input to the motor driving the wheel), is disclosed in U.S. Pat. No. 4,235,050 issued Nov. 25, 1980 to J. H. Hannaford et al. (Canadian patent No. 1,118,514 issued Feb. 16, 1982). This proposed solution has, however, not been found reliable or satisfactory in practice.

SUMMARY OF THE PRESENT INVENTION

It is the principal objective of the present invention to provide an alternative solution to the problem of ensuring substantial uniformity of depth of cut throughout the length of the blade, especially the "end effect" problem, by a system that is both simple in construction and more accurate and reliable in practice than any machine hitherto constructed.

To this end, the inventive concept, in its broadest scope, provides for effecting relative movement of the blade and the wheel in an arc that is curved in the same direction as the profile of the blade edge.

In a preferred form of the invention, the wheel is mounted in a vertical plane at a fixed location in the machine and the skate is mounted blade down in a cradle assembly that is located above the wheel, the central longitudinal plane of the blade being coplanar with the central plane of the wheel. The cradle assembly is pivotable about an axis that extends parallel to the axis of the wheel at an upper location in the machine. Hence both the blade profile and the traversing arc of the blade over the wheel are curved in the same direction, i.e. convexly downwardly. If the curved profile of the blade edge were a simple circular arc, it would be possible to compensate fully for such curvature, and especially for the "end effect," by locating the cradle assembly axis coincident with the center of curvature of the blade profile. However, only the central part of the blade profile is even approximately circular. As already mentioned, towards the ends the blade curves up relatively sharply, such curvature being different at the heel portion from the toe portion. In addition, a figure skate has a differently shaped toe portion from that of a hockey skate, and it is desirable that the same machine should be able to sharpen both types of skate. Hence, as a practical matter, the axis of the pivotted cradle assembly can be located to compensate reasonably well for the comparatively gentle and substantially circular curvature of the central portion of the blade profile. However, it can at the same time compensate only partially for the more sharply curved end portions.

For this reason, a further feature of the machine disclosed herein relates to a system for obtaining additional compensation for the "end effect." This result is achieved by increasing the speed of relative movement between the blade and the wheel when grinding the end portions of the blade. The depth of cut taken by the wheel is related not only to the strength of the biassing force and its direction relative to the normal to the blade edge at the point of contact, but also to the length of time that the wheel remains in contact with each part of the blade. In other words, other factors being equal, a grinding wheel that passes quickly over a workpiece will take a shallower cut than one that passes more slowly. This effect is exploited in the present machine by arranging for the relative motion, e.g. travel of the cradle assembly, to be speeded up when the end portions of the blades are in contact with the wheel.

Other features of the machine are explained below and in the accompanying claims.

BRIEF DESCRIPTION OF THE DRAWINGS

A machine embodying various preferred features of the present invention is illustrated by way of example in the accompanying drawings, in which.

DESCRIPTION OF THE PREFERRED EMBODIMENT

Figure 1:
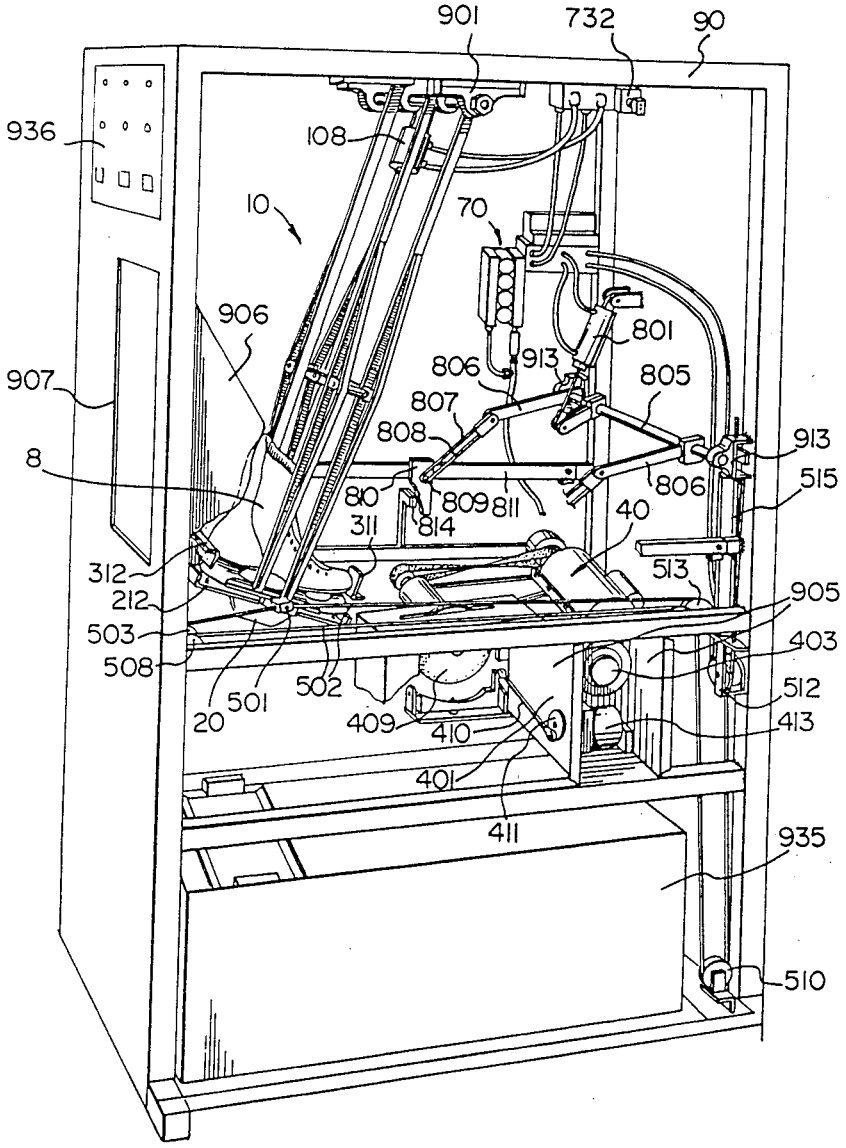
FIG. 1 is a perspective, overall view of the machine with the near side door of the housing removed.

For convenience the machine has been illustrated and will be described as a series of sub-systems, as follows:

(a) A cradle assembly 10, the parts of which are identified by reference numerals beginning 100.

(b) A skate detector 20, the parts of which are identified by reference numerals beginning 200.

(c) A skate positioning assembly 30, the parts of which are identified by reference numerals beginning 300.

(d) A grinding assembly 40, the parts of which are identified by reference numerals beginning 400.

(e) A cradle drive mechanism 50, the parts of which are identified by reference numerals beginning 500.

(f) A cradle position detection system 60, the parts of which are identified by reference numerals beginning 600.

(g) A control system 70, the parts of which are identified by reference numerals beginning 700.

(h) A door moving system 80, the parts of which are identified by reference numerals beginning 800.

(i) A housing frame 90, the parts of which are identified by reference numerals beginning 900.

THE CRADLE ASSEMBLY 10

Figure 2:
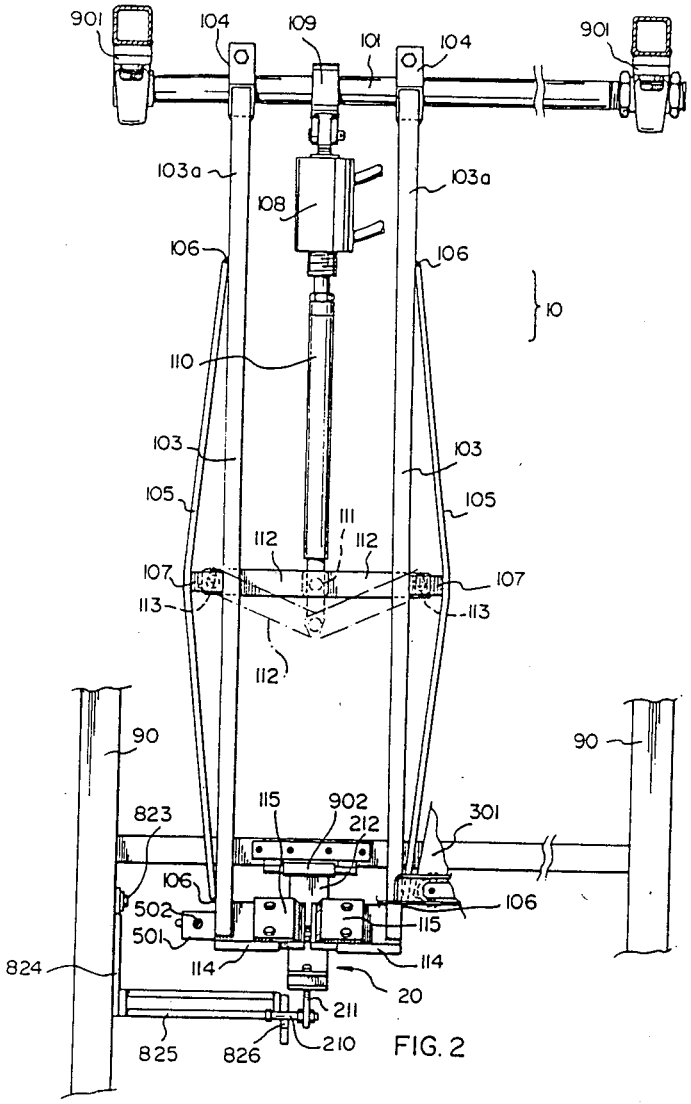
FIG. 2 is a view of a cradle assembly and some related parts, as seen from the right hand side of FIG. 3.
Figure 3:
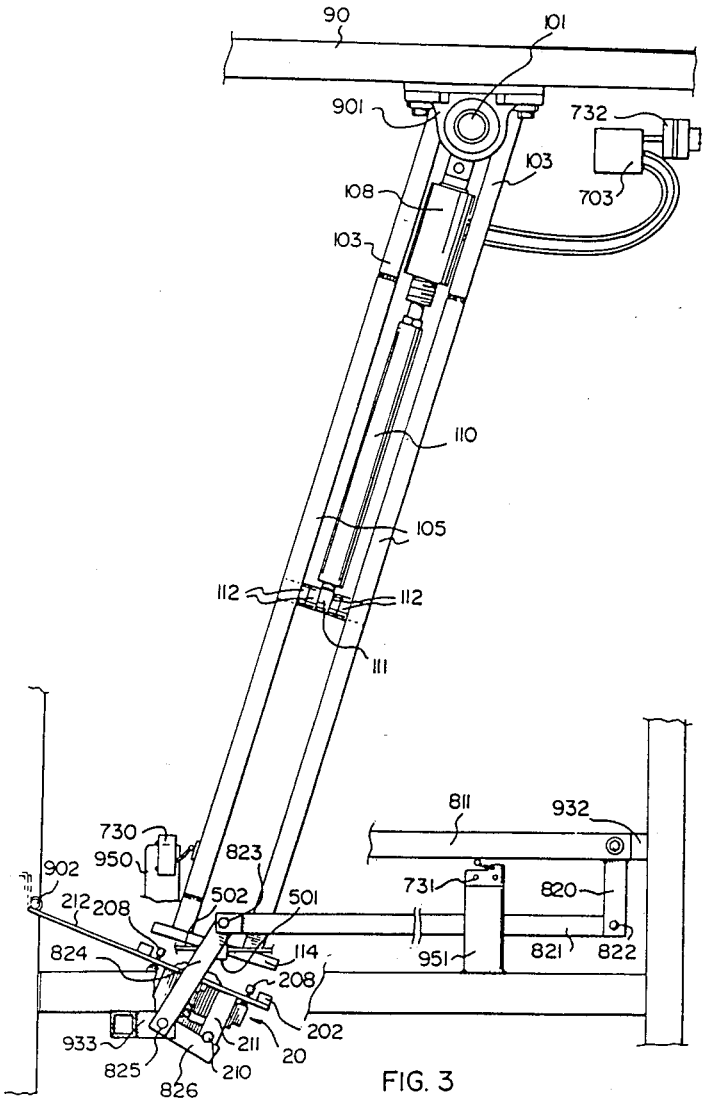
FIG. 3 is a side view of the cradle assembly and some related parts as seen from the left hand side of FIG. 2.

The details of the cradle assembly 10 are shown in FIGS. 2 and 3. An upper pivot shaft 101 is journalled in brackets 901 fixed to the frame 90. Depending from the shaft 101 are four arms 103 freely mounted by journals 104 on the shaft 101. The majority of the length of each of the arms 103 is stiffened by a stiffener 105 which is welded at its ends 106 to the respective arm and is connected thereto at the center by a mounting 107.

A hydraulic cylinder 108 mounted on the shaft 101 by a journal 109 has a piston 110 that is pivoted at 111 to pairs of transverse links 112 that are pivoted at 113 to the mountings 107. Downward movement of the piston 110 by the cylinder 108 moves the links 112 to the broken line positions shown in FIG. 2, drawing the arms 103 inwardly towards each other. By virtue of the stiffeners 105 the effect of this inward movement is to flex the arms 103 about their unstiffened upper portions 103*a* and force the lower ends 114 of the arms towards each other. These lower ends 114 carry clamping plates 115 that act to clamp a skate blade between them in a manner and for a purpose that will appear more clearly below. It should however be noted that, by virtue of the fact that the skate blade is clamped by a pair of plates that move in unison towards each other, the central longitudinal plane of the clamped blade will always lie in a predetermined plane regardless of the thickness of the blade. In this connection, it should be noted that figure skate blades are generally thicker than those of hockey skates. Moreover, even within one of these types of blade there can be thickness variations among manufacturers. This predetermined central plane of clamping is, of course, arranged to coincide with the central plane of the grinding wheel, so that the peak of the convexity on the wheel will always be aligned with the peak of the concavity in the blade.

Figure 7:
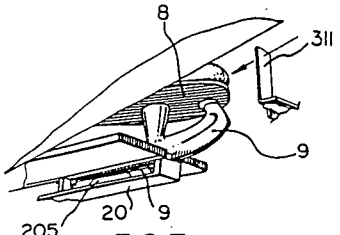
FIG. 7 is a fragmentary view showing a skate initially placed on the cradle assembly.

It should also be noted that the inward force exerted by the clamping plates 115 is made sufficiently great and these plates are dimensioned to engage a sufficient length of a blade 9 (FIG. 7) that any initial lack of straightness in the blade will be eliminated by the clamping action. Such straightening action thus serves to ensure the desired coincidence of the central plane of the grinding wheel with the central longitudinal plane of the blade throughout its entire length.

THE SKATE DETECTOR 20

Figure 4A:
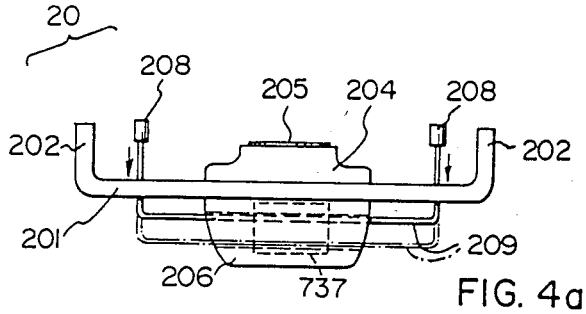
FIG. 4*a* is a side view of a skate detector, as seen from below in FIG. 4*b;*
Figure 4B:
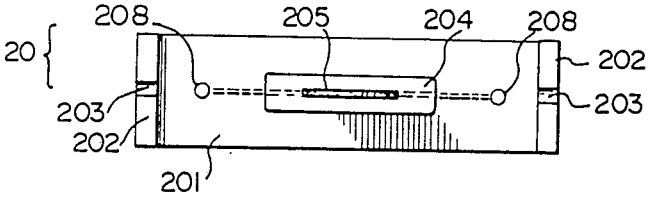
FIG. 4*b* is a view as seen from the top of FIG. 4*a;*

The skate detector 20 is mounted beneath the clamping plates 115, as shown in FIGS. 2 and 3. Details of the skate detector 20 are better seen from FIGS. 4*a* and 4*b* . This detector consists of a plate 201 having ends bent up to form upstanding skate supports 202 each containing a centrally located, blade centering groove 203. Centrally of the plate 201 there is a body 204 on the upper surface of which there is a magnet 205. A portion 206 of this central body 204 projecting below the plate 201 contains a known type of detecting mechanism 737, e.g. a lamp and photocell device. A pair of pins 208 project upwardly through holes in the plate 201 in alignment with the grooves 203. The pins 208 are mounted on the arms of a U-shaped member 209, the central portion of which is spring urged upwardly and passes through the detecting mechanism 737. As shown by broken lines in FIG. 4*a*, when both the pins 208 are depressed, the central portion of the member 209 moves to a lower position relative to the mechanism 737. The depressed position of the member 209 is thus detected by the mechanism 737.

Alternatively, any other convenient detecting mechanism can be used that will confirm that a skate blade is in position between the clamping plates 115, e.g. a pair of spaced apart photosensors that directly sense front and rear parts of the blade without the intermediary of the pins 208 and member 209.

As shown in FIGS. 2 and 3, the skate detector 20 is located beneath the clamping plates 115 of the cradle assembly 10 in such a manner as to be movable between a raised and a lowered position. For this purpose, it is mounted on an arm 212 that is freely pivoted to the frame at 902. Shown in these views in its lowered position, the detector 20 can be raised by a vertical member 211 secured to it. The member 211 carries a horizontal pin 210 that is controlled by parts of the door moving system 80 in the manner described below.

THE SKATE POSITIONING ASSEMBLY 30

This assembly 30 is secured to the far side of the cradle assembly 10 as seen in FIG. 1, for which reason it is largely obscured in that figure. However a fragment of the frame 301 of the assembly 30 is shown in FIG. 2 to make it clear that the assemblies 10 and 30 swing together on the shaft 101.

Figure 5:
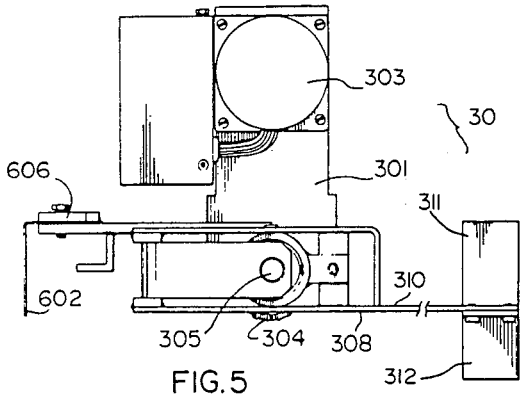
FIG. 5 is an end view of a skate positioning assembly.
Figure 6:
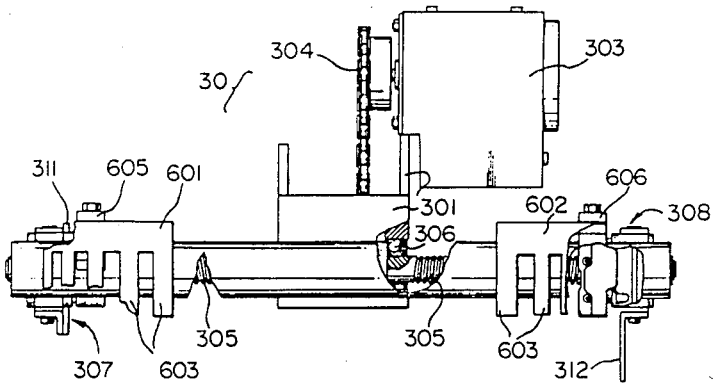
FIG. 6 is a view as seen from the left of FIG. 5.

Details of the skate positioning assembly itself are shown in FIGS. 5 and 6, where it will be seen that the frame 301 supports a motor 303 that, through a chain 304, drives a threaded shaft 305 mounted in bearings 306 in a central housing. As will be apparent from FIG. 6, the shaft 305 has two ends that project in respective directions from the bearing housing, these ends being respectively provided with right and left hand threads. On the left hand end of the shaft 305 there is a toe carriage 307 and on the right hand end a heel carriage 308. Rotation of the shaft 305 by the motor 303 will move these carriages 307, 308 in unison either towards or away from each other. The carriages 307, 308 respectively carry laterally projecting arms 309, 310 (see also FIG. 9) that extend towards the cradle assembly. On the ends of these arms 309, 310 there are respectively an upwardly projecting toe stop 311 and a downwardly projecting heel stop 312 (also seen in FIG. 1).

THE GRINDING ASSEMBLY 40

Figure 10:
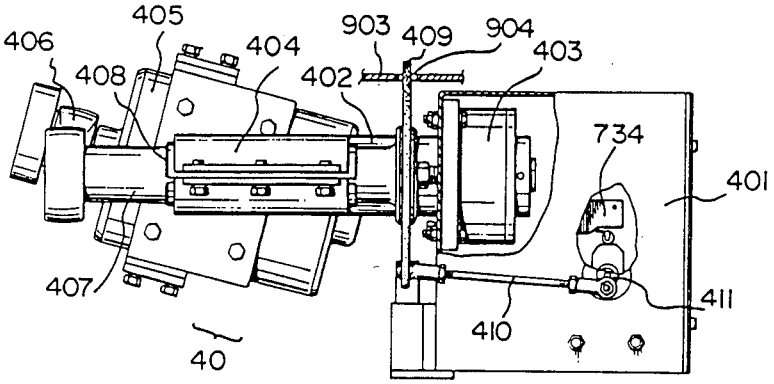
FIG. 10 is a side view of a grinding assembly, looking horizontally, and with some parts cut away.
Figure 11:
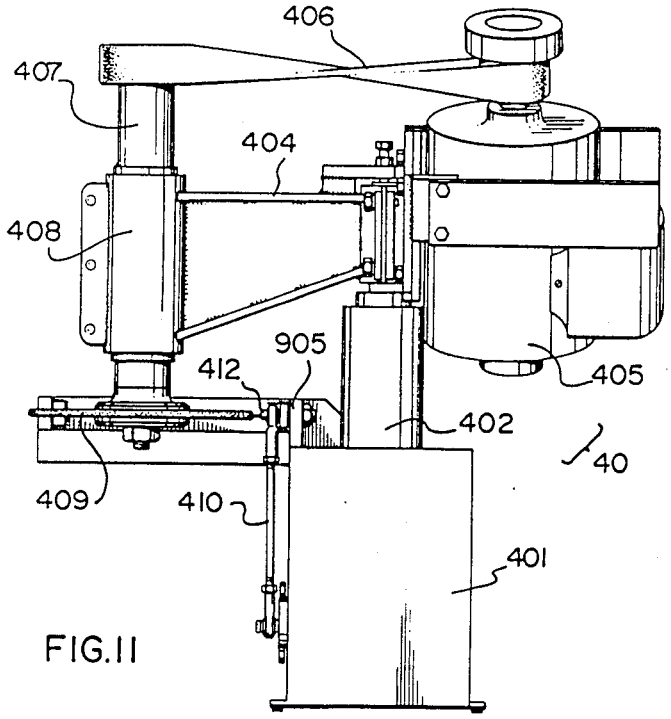
FIG. 11 is a plan view as seen from the top of FIG. 10, and with some parts omitted.
Figure 12:
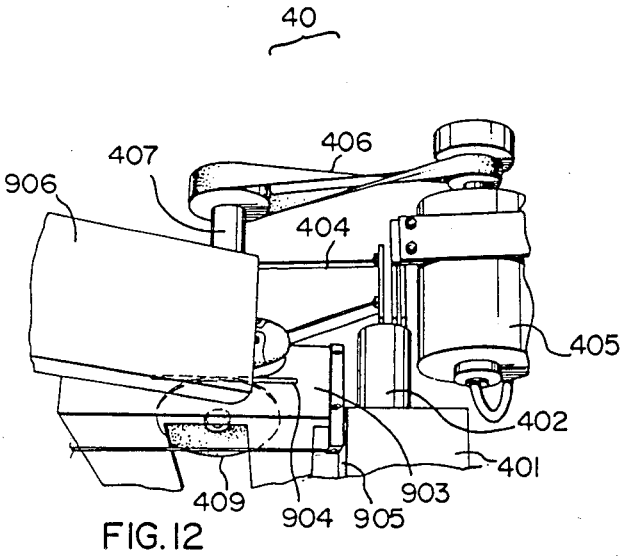
FIG. 12 is a perspective view of the grinding assembly illustrating its operation.

The grinding assembly 40, which is shown in detail in FIGS. 10, 11 and 12 and in location in the machine in FIG. 1, has a fixed housing 401 mounted in the frame 90. The housing 401 pivotally supports a projecting shaft 402 and, as seen in FIGS. 1 and 10, contains an electromagnetic brake 403 mounted on the inner end of the shaft 402. On its projecting end the shaft 402 is connected to a frame 404 which is thus tiltable with the shaft about its longitudinal axis. On one side the frame 404 supports a motor 405 that drives through a belt 406 to one end of a shaft 407 that is journalled at 408 on the other side of the frame 404. The other end of the shaft 407 supports a grinding wheel 409 that projects through a slot 904 of a frame plate 903 (FIG. 10). A conventional wheel dressing assembly has an arm 410 operated by a crank 411 from an auxiliary motor 413 (FIG. 1) in the housing 401. The arm 410 carries a head 412 for oscillation in an arc across the face of the grinding wheel 409 for cleaning and dressing the same with the desired convex shape. Since this dressing assembly is known, no further details need discussion.

THE CRADLE DRIVE MECHANISM 50

Figure 13:
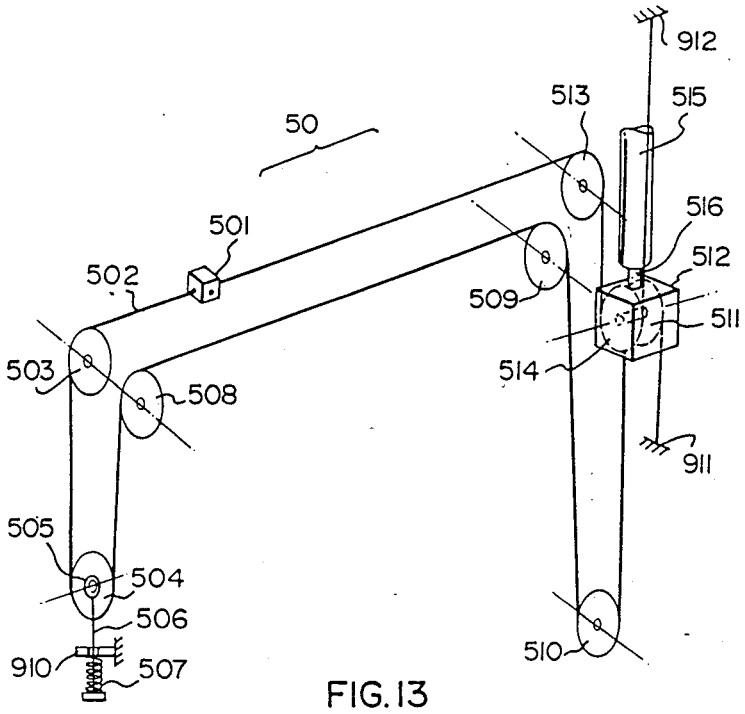
FIG. 13 (on the sheet with FIGS. 4*a* and 4*b*) is a diagrammatic perspective view of a cradle drive mechanism.

The cradle drive mechanism 50 is principally shown in FIG. 13 and will be seen to consist of a block 501 that is connected to the cradle assembly 10 at a lower end thereof (see also FIGS. 1, 2 and 3 for this detail). A cable 502 extends in both directions from the block 501. Starting from the block 501 a part of the cable 502 extends to the left in a generally horizontal direction to pass over a vertical pulley 503 from where it extends downwardly to pass around a further vertical pulley 504, the shaft of which is supported in a journal 505 connected to a bolt 506 that is spring urged downwardly by a spring 507 relative to a fixed stop 910 of the frame 90. The spring 507 thus serves to maintain tension in the cable 502. From the pulley 504, the cable continues over further vertical pulleys 508, 509 and 510 and over one pulley 511 of a pulley block 512. After the pulley 511 it extends to an anchor 911 on the frame. Extending in the other direction from the block 501, the cable 502 passes over a pulley 513 and a second pulley 514 of the block 512 to an anchor 912. The block 512 which mounts the pulleys 511 and 514 is connected to a piston 516 of a cylinder 515 secured to a frame bracket 913 (FIG. 1). With the pulley block 512 in the upper position shown in FIGS. 1 and 13, the cradle assembly 10 is in its starting position. As the cylinder 515 is expanded to force the block 512 downwardly, the cradle assembly 10 is swung to the right in accordance with the operating sequence described below. Reverse travel of the cradle assembly is achieved by retraction of the piston 516 and consequent raising of the pulley block 512.

THE CRADLE POSITION DETECTION SYSTEM 60

Figure 9:
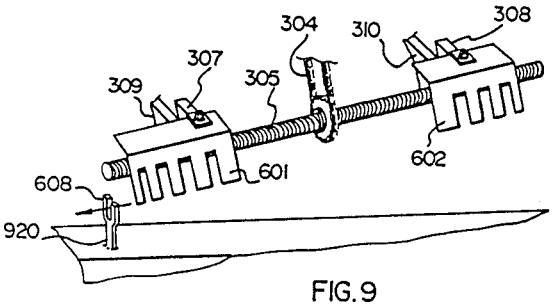
FIG. 9 is a diagrammatic perspective view of part of the skate positioning assembly together with a cradle position detection system as seen from the far side of the machine.
Figure 15:
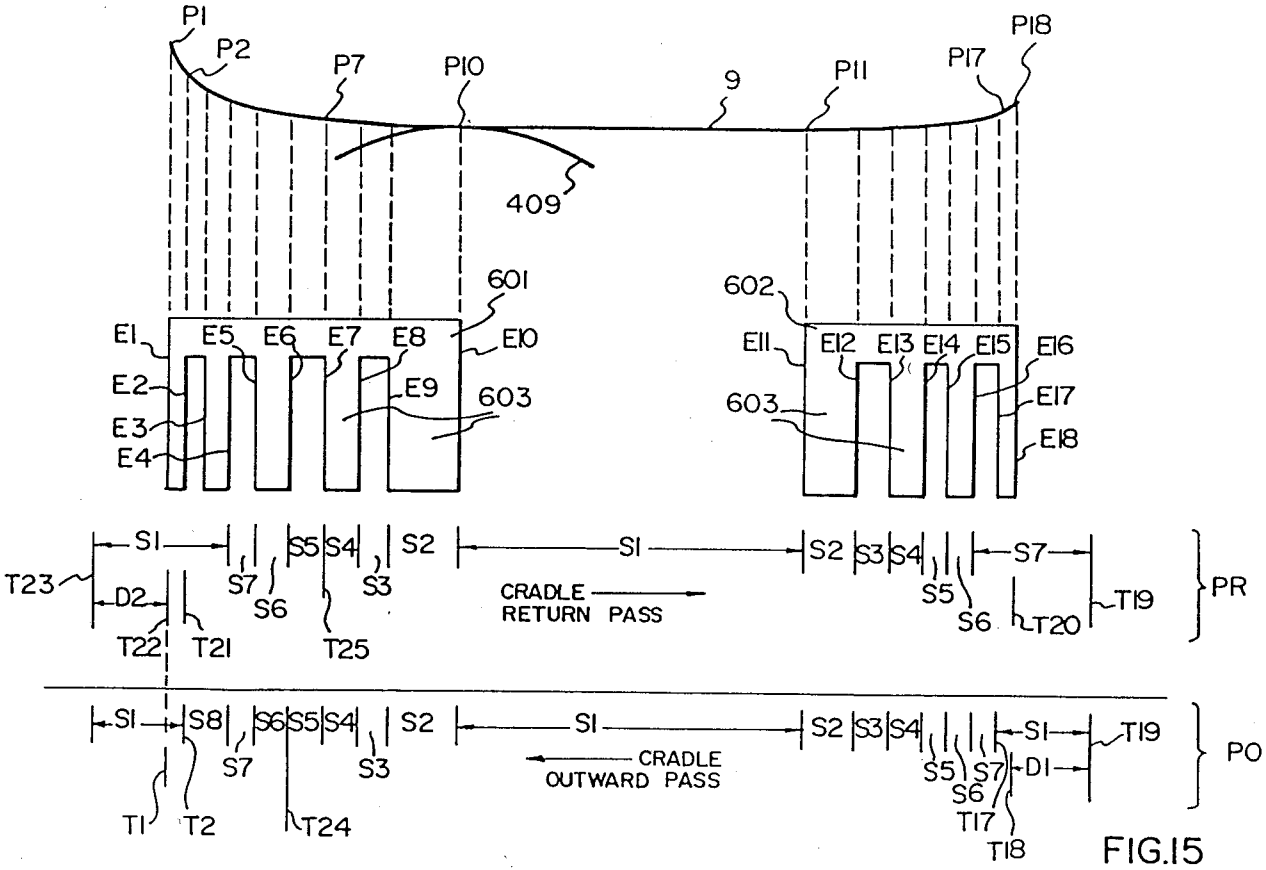
FIG. 15 is a diagram illustrating the manner of operation of the cradle position detection system.

The cradle position detection system 60 shown in FIGS. 6, 9 and 15 consists of a pair of plates 601, 602 secured to respective carriages 307, 308 of the skate positioning assembly 30 by mountings 605, 606. The plates 601, 602 are each notched to form fingers or flags 603. As suggested somewhat diagrammatically in FIG. 9, mounted on the frame at 920 is a bificated post 608 through which the flags 603 of the plates 601, 602 pass when the cradle assembly 10 is swung from its start position of FIGS. 1, 3 and 9. The post 608 carries a known light and photocell device that detects passage therethrough of each of the edges, leading and trailing, of each of the flags 603. This function is more fully described below in connection with the overall operation of the machine.

THE CONTROL SYSTEM 70

Figure 17:
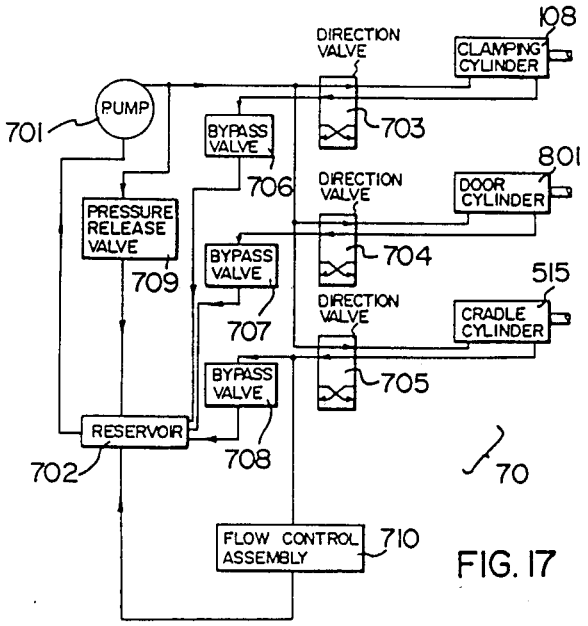
FIG. 17 is a diagram of part of a control system.

FIG. 17 shows the hydraulic circuit of the control system. Fluid is drawn by a pump 701 from a reservoir 702 and supplied under pressure to each of three reversible direction valves 703, 704 and 705 that respectively supply the clamping cylinder 108, a door cylinder 801 and the cradle cylinder 515. In the forward positions of the valves shown, these cylinders are driven in their forward directions. To reverse their movements, the respective valves are moved upwardly to their reverse positions. On the discharge side, each of the valves 703, 704 and 705 passes fluid to a respective bypass valve 706, 707 and 708, whereby such fluid is returned to the reservoir 702. A general pressure release valve 709 maintains the desired pressure on the pressure side of the pump 701. In addition a flow control assembly 710 is connected between the reservoir 702 and the discharge side of the valve 705 controlling the cradle cylinder 515. The function of this assembly 710 is described in more detail below.

The control system 70 also includes a number of limit switches, namely a limit switch 730 (FIG. 3) mounted on a frame member 950 for detecting that the cradle assembly 10 is in its start position; a limit switch 731 (FIGS. 3 and 16) mounted on a frame member 951 for detecting the condition of the door closing system 80; a limit switch 732 (FIGS. 1 and 3) mounted on the frame 90 for determining the pressure in the valve 703 and hence in the cradle cylinder 108; and a limit switch 734 (FIG. 10) mounted in the housing 401 for determining the status of the grinding wheel dressing device.

THE DOOR MOVING SYSTEM 80

The door moving system 80 (FIGS. 1 and 16), employs a cylinder 801 pivotally mounted on the frame at 930 and having a piston 802 connected to an arm 803 at a pivot 804. The arm 803 is connected to a transverse shaft 805 mounted on the frame at 931. The shaft 805 serves to turn a pair of arms 806, one of which is located on each side of the machine as best seen in FIG. 1. Each arm 806 supports at its free end a further arm 807 that has a longitudinal slot 808. This slot engages a pin 809 of a block 810 that is pivotally mounted on a pin 816 secured to an arm 811. The block 810 terminates in a hooked portion 812 and is urged by a spring 815 to engage an upper end 814 of a vertical member 813.

Figure 16:
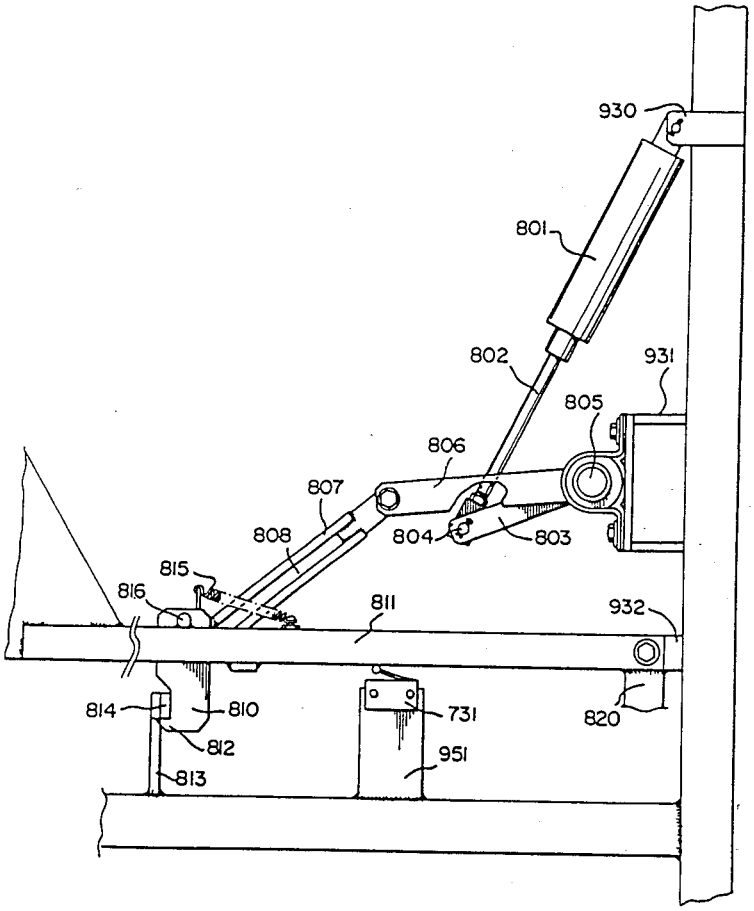
FIG. 16 is a fragmentary view illustrating part of a door closing system.

On the left hand end seen in FIG. 16, the arm 811 supports a door (not shown) that is mounted to slide to open and close an opening 907 at the front of the housing. Behind the opening 907 there is an enclosure 906 (shown partly cut away in FIG. 1) designed to protect the hand of a user when he is inserting a skate 8 into the machine.

From the other end of one of the arms 811 (right hand end of the near arm) there depends a member 820 (see also FIG. 3) that can turn with the arm 811 about a pivoted mounting 932 on the frame. The lower end of the arm 820 is pivotally connected at 822 to a horizontal link 821 that at its far end is pivoted at 823 to a link 824 (see also FIG. 2) that in turn is connected to an arm 825 that extends laterally beneath the cradle assembly 10, terminating in a arm 826 that engages the pin 210 of the device 20 for moving it between the lower position shown in FIG. 3 and a raised position (not shown) in which it will have been turned somewhat anti-clockwise about the pivot 902 to lie more closely beneath the clamping plates 115 with its magnet 205 parallel to and centred on the gap between the clamping plates 115.

THE FRAME 90

Virtually all the significant parts of the frame 90 have already been described in relation to their support of the various sub-systems. However, FIG. 1 also shows a tank 935 at the foot of the frame 90 for containing coolant that is sprayed onto the grinding wheel in a known manner (not otherwise described or illustrated) and a control panel 936 for operation by the user. The housing will be completed by a door on the near side seen in FIG. 1, which door can conveniently serve to support a microcomputer assembly (not shown) that will form part of the control system 70, and may also include a conventional coin operated mechanism (not shown) for energising the machine.

OPERATION OF THE MACHINE

Assuming that the machine has been turned on, either by a coin operated mechanism or the like, or by a master switch, the following sequence of steps is carried out under the control of the microcomputer.

(1) The number of passes of the cradle assembly 10 since the grinding wheel 409 was last dressed is checked and, if above a selected number, the dressing assembly motor 413 is actuated. When the dressing operation is complete, or was not carried out, the ready status of the wheel 409 is signalled by the limit switch 734.

(2) Location of the cradle assembly 10 in its start position is detected by the limit switch 730. If it is not, the cradle cylinder 515 is retracted to bring it to this start position.

(3) The door to the opening 907 is opened by the cylinder 801 by moving the valve 704 to the position opposite to that seen in FIG. 17. This action involves the arms 807 pulling up on the pins 809 to rotate the blocks 810 to unlatch the hooked portions 812, 814, which allows the arms 811 to rotate upwards about the mountings 932. Raising of the door enables the operator to insert a skate 8 toe first, as shown in FIG. 1. The front face of the housing will contain appropriate instructions for the operator. Opening of the door also raises the skate detector 20 through the members 820 to 826, 210 and 211.

(4) The blade 9 of the skate will pass between the clamping plates 115 to engage and be lightly held by the magnet 205 of the skate detector 20, while resting in the grooves 203 and depressing the pins 208 to activate the detecting mechanism 737 and hence signal the presence of a skate blade to the control system.

Figure 8:
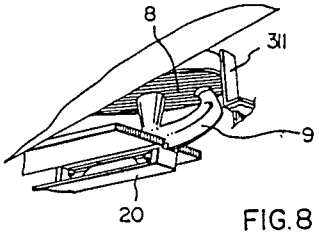
FIG. 8 is a view similar to FIG. 7 at a later stage in the operation.
Figure 14:
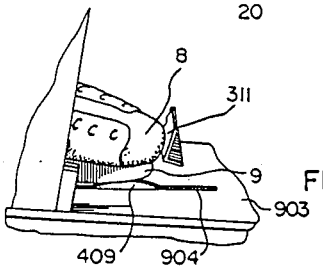
FIG. 14 (on the sheet with FIGS. 7 to 9) is a fragmentary perspective view showing a stage in the operation in the machine.

(5) The skate positioning assembly 30 is then actuated, e.g. motor 303, in the direction to move the toe and heel stops 311, 312 towards each other to engage the respective ends of the skate. Compare FIGS. 7 and 8. The effect of this movement is to ensure centering of the skate blade in the longitudinal direction, regardless of how far forward or rearward it has been inserted by the operator. Firm engagement of both ends of the skate by the stops 311, 312 is detected by limit switches (not shown) in the toe and heel carriages 307, 308 that sense refusal of these stops to move any further.

(6) The control system then moves the valve 703 to the position shown in FIG. 17 to energise the cylinder 108 to clamp the blade tightly between the plates 115. Achievement of tight clamping is reflected in a build up of pressure in the cylinder 108, which is detected by the limit switch 732. Any subsequent loss of such pressure would be detected by the switch 732 to halt the operation of the machine. The motor 303 is deenergised but not reversed, so the stops 311, 312 remain in engagement with the ends of the skate.

(7) The door is now closed by returning the valve 704 to its FIG. 17 position to expand the cylinder 801. The downward sliding movement of the door takes place under gravity only, being merely permitted rather than forced by the return movement of the mechanism 80, so that the operator is not harmed if his hand is still inserted into the opening 907. He will, of course, have been instructed to remove his hand from the machine as soon as he had inserted the skate in step (3) above, and the sequence of steps will be controlled with appropriate delays to ensure that he has had adequate time for this purpose. In any event, while the cylinder 801 will have been fully expanded to move the arms 807 to the position shown in FIG. 16, the pins 809 will only have reached the end of their slots 808 if the arms 811 have been permitted by a fully closed door to reach the position shown in FIG. 16. Until this occurs (indicating that the operator's hand must have been removed from the machine), the latches 812, 814 will not reengage. When they do, they prevent the door being raised again except by operation of the cylinder 801. At this time the limit switch 731 signals that the door is in the closed and latched condition. It also indicates that the skate detector 20 has been allowed to drop clear of the blade by lowering of the member 826. Should the magnet 205 be strong enough to prevent this, the linkage connected to the door moving system that raises the detector 20 can be modified to lower it positively at this time.

(8) At this or some earlier stage in the operation the operator is invited, e.g. by flashing lights, to press appropriate control buttons on the panel 936 to indicate the type of skate, i.e. hockey or figure, and the depth of grinding he desires, e.g. light, medium or heavy. If a light grind is chosen, the machine makes one double pass (forward and back) of the skate over the wheel. For the medium and heavy grinds two and three double passes respectively are made.

HOCKEY SKATE (H9) Assuming a hockey skate has been inserted into the machine and so indicated on the panel 936, the control system turns on the supply of coolant to the wheel and starts to move the cradle assembly 10 by means of the valve 705 and the cradle cylinder 515. The speed of movement of the cylinder 515 and hence the speed of traverse of the cradle assembly 10 is controlled by the flow control assembly 710 in the exhaust flow from the cylinder. In the preferred form of flow control assembly, there is a series of valve controlled orifices that can be selectively opened or closed to enable the computer to select one of eight different increments of resistance to flow and hence one of eight different traversing speeds for the cradle assembly. Initially, the assembly 710 sets the traversing speed at its minimum value S1. FIG. 15 shows the blade 9 and the grinding wheel 409 as seen from the far side of the machine. The broken vertical lines indicate the relationship between points P1 to P18 on the blade 9 and edges E1 to E18 of the flags 603 that trigger signals in the photo sensor in the post 608. It is not necessary that the extreme toe end P1 of the blade 9 be physically aligned in the machine with the edge E1. All that is necessary is that the post 608 be so positioned that, when the centre of the wheel is directly below the point P1, the edge E1 is aligned with the beam in the post 608 to generate an appropriate signal. However, for convenience in the diagram of FIG. 15, actual alignment has been shown. The first outward pass P0, with the direction of movement of the cradle assembly from right to left, is shown at the bottom of FIG. 15.

(H10) As soon as the computer detects the first flag edge E1, i.e. at time T1, it starts the grinder motor 405. The brake 403 will already be released, except on subsequent forward passes, in which case it is now released. The weight of the motor 405 and that of any counterweight that is added to the motor 405 are made greater than the combined weights of the parts of the assembly 40 on the other side of the axis of the shaft 402, so that the wheel 409 is biassed upwardly when the brake 403 is released. There is, however, a stop (not shown) on the shaft 402 limiting eventual upward tilting of the frame 404 to avoid the wheel or its shaft fouling the plate 903. Between points P1 and P2 the wheel is assuming its full rotational speed and hence the traversing speed can be at the minimum value S1. In any case, exact uniformity in the depth of cut at this extreme end of the blade is less important that in the area beyond point P2.

(H11) When the computer detects edge E2 at time T2 (corresponding to the wheel 409 engaging the blade point P2), the traversing speed is increased by the flow control assembly 710 to the maximum value of S8.

(H12) The signal from the edge E3 is not used by the computer which waits for that from the edge E4 which reduces the speed to S7 and, so on, edges E5, E6, E7, E8, E9 and E10 reducing the speed by successive small increments to values designated S6, S5, S4, S3, S2 and S1 respectively. The latter speed is reached at time T10 when point P10 on the blade has reached the wheel 409. Typically the lowest speed S1 could be about half the highest speed S8.

(H13) The pass has now reached the central portion of the blade between points P10 and P11 where no compensation for depth of cut is required beyond that provided by the pivotal mounting of the cradle assembly.

(H14) When the flag edge E11 is detected a sequence of speed increases commences. As shown in the lower part of FIG. 15, edges E11 to E16 initiate speeds S2 to S7 respectively. Speed S8 is not used at the heel end of the blade due to the lesser curvature.

(H15) At edge E17, i.e. time T17, the computer reapplies the brake 403 so that the wheel cannot rise any further and the blade loses contact with it shortly after point P17. Point P18 is never in contact with the wheel. At the same time, i.e. time T17, the traversing speed is reduced to S1.

(H16) When the edge E18 is detected at time T18 the computer commences a time delay D1 after which at time T19 it reverses the direction of the cradle cylinder 515. The return pass PR is shown in FIG. 15 above the outward pass P0. The initial speed on the return pass is S7.

(H17) When the edge E18 is again detected at time T20 the brake 403 is again released and travel continues at speed S7 until edges E16 to E11 are each detected and used to reduce the speed through successive steps to S1.

(H18) As on the outward pass, the speed remains low at S1 across the central part of the profile, until edge E10 is again reached. Edges E10 to E4 progressively increase the speed up to S8. Then at edge E2 and time T21 the brake 403 is again applied.

(H19) At edge E1 and time T22, a second time delay D2 is commenced before the cradle assembly reaches the start position at time T23.

(H20) If the operator has selected more than one double pass (medium or heavy grind) the machine now repeats the same sequence of steps either once or twice. Once these repeat passes have been made, or if only one double pass was selected (light grind), the computer now stops the grinder motor 405 and allows the cradle cylinder 515 to continue to move the cradle assembly 10 until its attainment of its start position has been confirmed by the limit switch 730. The coolant flow is stopped when the grinding wheel stops.

(H21) The computer then reverses the skate positioning motor 303 to move the stops 311, 312 to their outward positions.

(H22) After the occurrence of this action has been confirmed by the respective limit switches, the computer reactivates the door opening cylinder 801. As the door is opened the skate detector 20 is again brought up to sense the presence of the skate. The computer then reverses the clamping cylinder 108 to release the blade 9 from the plates 115 and to enable the operator to remove the sharpened skate.

(H23) A short time delay, say three seconds, after the detector 20 has reported removal of the skate, the computer again closes the door. Closing and latching of the door must be detected by the computer, before a new cycle can be initiated.

FIGURE SKATE (F9) Assume now that a figure skate has been inserted into the machine and so indicated on the panel 936. The toe portion of a figure skate has picks that could be damaged by the wheel 409 if it were rotating. These picks are in the area defined between the points P1 and P7 of the hockey skate blade shown in FIG. 15. Hence, in the outward pass for a figure skate, the grinder motor 405 is not started until the edge E7 has been detected, i.e. at time T24. The brake 403 will have been released as before, i.e. by edge E2, so that the picks of the blade will have been able to depress the wheel 409 as they moved forward over it. By the time the edge E7 is reached, the wheel will be beyond the picks. The variations in the speed of traverse of the cradle assembly and other procedures follow the same sequence as for the hockey skate, i.e. steps H12 to H17.

(F10) On the return pass, again the same procedure is followed until the edge E7 is again detected, whereupon the brake 403 is applied, i.e. at time T25.

(F11) If a medium or heavy grind has been ordered, this procedure is repeated. If no repeat is called for, or after having performed the necessary repeats, the cradle cylinder 515 is again reversed and the brake 403 released. This means that, starting from the position P7 and with the grinding wheel still turning, the cradle assembly is again moved in an outward pass. The speed of travel is regulated as before, i.e. from S4 down to S1 and up again to S7. At the edge E17, the brake 403 is again applied. At the edge E18, the time delay D1 is again commenced. The grinder motor 405 is stopped and the travel direction reversed after the delay D1. A complete return pass is then made with the motor 405 no longer driven and the brake 403 released. This return pass continues until the cradle assembly has reached its start position as indicated by the limit switch 730, whereupon steps H21 to H23 are adopted. It will thus be seen that, for a light grind, a figure skate is moved in two double passes. The first double pass is the same as for a hockey skate, except that the front area of the blade (points P1 to P7) is not ground. The second double pass consists of an outward pass that is the same as the first outward pass and a return pass that is entirely ineffectual as far as grinding is concerned. Thus, in effect, there will be three grinding passes, compared to the two given to a hockey skate. On medium grind, a figure skate will receive five grinding passes and, on heavy grind, seven grinding passes. This procedure is adopted to enable the stopping of the grinding motor to take place when the wheel is out of contact with the blade.

ALTERNATIVE OPERATION

If desired, the operation can be so modified that the incremental changes in the traversing speeds from S8 down to S1 and up again to S7, the example for the outward pass P0 given in FIG. 15, is different for the return pass PR. For example, in the return pass a constant speed can be adopted throughout, or fewer increments can be used, say speed S2 between edges E18 and E11 and between edges E10 and E1 and speed S1 between edges E11 and E10. As a still further alternative, the return pass can retain the numerous increments of speed, while the outward pass is simplified. In other words, provided one of the passes is carried out at varying traversing speeds, it is not essential that the other be the same. However, to achieve uniformity of the ultimate depth of cut, i.e. after a pair of passes, and substantial elimination of the end effect, the speed or speeds adopted on the return pass will have to be taken into account in selecting the values chosen for the varying speeds on the outward pass, and vice versa.

The system is thus especially well adapted to modification to accommodate different blade profiles.

I claim:

1. A method of sharpening the bottom edge of the blade of an ice skate, said edge having a complexly curved, convex profile in side view, comprising the steps of (a) rotating about a horizontal axis a thin grinding wheel having a periphery with a convex transverse cross-section corresponding to a desired concave transverse cross-section of said blade edge, (b) placing the blade in clamping means located above the wheel and having open and closed positions, with said blade depending from said clamping means, (c) moving a skate detector from a withdrawn position to an active position in which it is located closely below the clamping means when the latter is in a start position withdrawn from the wheel to detect said skate blade depending from the clamping means, (d) upon detection of the skate blade by said skate detector moving a pair of stops in unison from an open position towards each other to engage end portions of the skate to center the blade longitudinally in the clamping means, (e) moving the clamping means from its open position to its closed position to clamp the blade with the central longitudinal plane of the blade coplanar with the central plane of the wheel regardless of the transverse thickness of the blade, and (f) pivoting the clamping means about a horizontal axis parallel to and above the axis of the wheel to move the clamping means through a sequence of grinding positions in which the blade edge is in grinding contact with the wheel, such movement effecting longitudinal movement of the blade edge relative to the wheel in an arc that is curved in the same direction as said edge profile, the wheel being biassed against the blade edge to remove a cut therefrom.

2. The method of claim 1, wherein movement of the clamping means to closed position is initiated by sensing completion of the longitudinal centering movement of said pair of stops.

3. The method of claim 2, including moving access means between an open position in which a user can place a skate in the clamping means and a closed position in which access to the clamping means by the user is prevented.

4. The method of claim 3, including sensing closure of the clamping means to move the access means to its closed position.

5. The method of claim 4, including moving the skates detector between its withdrawn and active positions and linking the skate detector with the access means whereby the open position of the access means corresponds to the active position of the skate detector and the closed positon of the access means corresponds to the withdrawn position of the skate detector.

6. The method of claim 5, including sensing movement of the access means to its closed position for actuating the pivoting of the clamping means.

* * * * *